US006828743B2

(12) United States Patent
Debuf

(10) Patent No.: US 6,828,743 B2
(45) Date of Patent: Dec. 7, 2004

(54) METHOD AND DEVICE FOR CONTROLLING A WINDER

(75) Inventor: Geert Debuf, Drongen (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 10/199,491

(22) Filed: Jul. 22, 2002

(65) Prior Publication Data

US 2003/0015981 A1 Jan. 23, 2003

(30) Foreign Application Priority Data

Jul. 20, 2001 (BE) ..... 2001/0496

(51) Int. Cl.[7] ..... H02P 1/04

(52) U.S. Cl. ..... 318/430; 318/432; 318/434; 318/566; 242/75.1; 242/75.2; 242/75.3; 242/413.1; 242/413.2

(58) Field of Search ..... 318/430, 432, 318/434, 566; 242/75.1, 75.2, 75.3, 413.1, 413.2

(56) References Cited

U.S. PATENT DOCUMENTS 3,871,598 A 3/1975 Kataoka
3,910,521 A 10/1975 O'Callaghan et al.
4,146,190 A 3/1979 Bond et al.
4,238,084 A 12/1980 Kataoka
5,623,189 A 4/1997 Hemmer

*Primary Examiner*—David Martin
*Assistant Examiner*—Tyrone Smith
(74) *Attorney, Agent, or Firm*—James Creighton Wray; Meera P. Narasimhan

(57) ABSTRACT

A method and a device for controlling a winder, where the winding torque ($T_w$), during winding, is controlled as a function of the desired tractive force in the material to be wound. During winding, repeatedly is calculated which value a quantity ($V_i$), influencing the winding torque ($T_w$), has to adopt in order to obtain a desired tractive force ($F_w$), and an adjustment of the said quantity ($V_1$) is carried out, the calculated value being used as an objective value. Preferably, the calculation is done by an algorithm, expressing the said quantity as a function of the desired tractive force ($F_w$), as a function of one or more fixed parameters which are characteristic for winding up material or for the winder, and as a function of one or more variable parameters, being measured or calculated during winding. The device also relates to a winder comprising a winding body (1), (2) for winding a material, a drive device (3,9), (4,10) for driving this winding body (1), (2) an a control device.

20 Claims, 1 Drawing Sheet

METHOD AND DEVICE FOR CONTROLLING A WINDER

This application claims the benefit of Belgian Application No. 2001/0496 filed Jul. 20, 2001.

BACKGROUND OF THE INVENTION

This invention relates to a method and a device for controlling a winder, where the winding torque is controlled as a function of the desired tractive force in the material to be wound.

This invention likewise relates to a winder comprising a winding body for winding a material, a drive device for driving this winding body and a device for controlling the winder, which is provided for automatically controlling the winding torque of the winder as a function of the desired tractive force in the material.

More particularly, this invention relates to such a method and device for controlling a device for winding a textile material, more particularly for winding a pile tissue, and more particularly to such a device which is installed in the vicinity of a weaving machine to wind a textile material, during its being woven on the weaving machine. A winder for such an application also falls within the scope of the present invention.

It is known that when winding a flexible product (for instance a fabric, paper or a sheet material on a winding cylinder, the driving torque must increase as the winding diameter increases, in order to exert a constant tractive force. To achieve this objective special winders were developed equipped with a controlling system provided for to measure the winding force or the winding torque of the winding cylinder at a certain difference between the measured value and a desired value in order to accomplish an adjustment of the winding torque, so that this difference is annulled or reduced. These systems operate with short cycle times and powerful speed-torque controls to perform the winding at high winding speed at a high precision. When starting and stopping the speed and the winding torque are carefully regulated. These systems require a control system which operates in a closed loop and which comprises corresponding position localizers for a dancer roll and torque and power sensors in the drive. The sensors find a difference and the control system must annul or reduce this difference. Such systems operate reactively.

These devices have the disadvantage of being rather expensive and because of the necessity of a dancer roll they take up quite some space. With a number of ranges of application (for instance a winder for a weaving machine) there is not enough space available for a dancer device. Moreover the winding speeds of the woven fabric are very low (in the order of some cm per minute) with fabrics having a high weft density up to some dozens of cm/min for fabrics having a low weft density), because of which the expensive reactive regulating systems are not justified from an economical point of view.

Therefore simple, solid and yet affordable systems are often chosen for winding devices for weaving machines. In known winding devices for weaving machines torque motors or rotating field magnets are used, developing a torque applied to the winding spindle of the winding device via a high efficiency gear transmission. The torque developed by the torque motor is proportional to the square of the voltage applied to the motor. This voltage is adjusted by means of a regulating variable transformer, which is manually adjusted at the beginning of the winding process and which is readjusted periodically during the weaving process. Such drives are very simple, solid, free of maintenance and cheap.

However, these known winders also have some disadvantages. The tractive force in the fabric during winding must be adapted to the fabric characteristics: delicate fabrics are wound with a low tractive force in order to prevent the fabric from getting creased, heavier fabrics are wound with a stronger winding force to avoid the fabric from turning with the pulling cylinder or dragging on the floor under the influence of its heavy own weight.

As the fabric itself is thicker, readjusting as a function of the winding diameter is needed more frequently between the initial and the final diameter. Moreover, the torque at a greater final diameter must also be relatively higher for a same fabric length than for a thin fabric.

Winding up pile fabrics is still more delicate because crushing the pile by winding the fabric too tightly because of too strong a tractive force in the fabric should be avoided. On the other hand, winding the fabric too loosely is not good either because the cylinder will hang too one-sidedly on the part to be wound up and therefore will leave tracks on the pile surface. Because of the pile height the fabric is rather thick and an accurate readjustment of the torque by hand during weaving should be carried out more frequently.

Therefore, this system of manual readjustment of the winding torque during the weaving process includes certain dangers as the quality of the fabric is concerned and the quality of the winding therefore requires a rather high intervention of the operators. Moreover, much time is lost by redefining the best position of the variable transformer to wind a certain fabric having a certain winding diameter under the best circumstances. This readjustment is still more complicated because of the fact that readjusting by means of a variable transformer is not functioning linearly.

SUMMARY OF THE INVENTION

The purpose of the present invention is to provide for a method and a device to control a winder by means of which the driving torque of the winding element can be efficiently controlled as a function of a desired tractive force in the material that is wound, and by means of which the disadvantages mentioned above are remedied.

This purpose is achieved by applying a method according to this invention and by providing a device with which during the winding process repeatedly:

is calculated which value a quantity ($V_i$) influencing the winding torque ($T_w$) has to adopt in order to obtain the desired tractive force ($F_w$), whereas in each calculation of the value of said quantity ($V_i$) a winding torque to be developed is assumed which is determined from the desired tractive force ($F_w$), the initial winding diameter ($d_0$), the thickness ($S_w$) and the winding length ($l_w$) of the wound up material, and an adjustment of the said quantity ($V_i$) is made, in which the calculated value is used as an objective value.

Therefore, the quantity to be regulated is now pro-actively calculated, for instance accordingly to a mathematical model as a function of a number of parameters. In this manner, a material (for instance a fabric) may be wound up with a tractive force that can be adjusted to an ideal value during the winding process without any manual intervention. This value can be tuned to the characteristics of the material. In this way, a fabric can be wound up during the weaving process while the tractive force is kept at a constant value. This method can be implemented with a control device needing no dancer roll that takes up relatively little space and which is simpler and less expensive than the control devices in existence.

Once experienced which tractive force is best to wind up a material, the tractive force is stored (for instance in a computer file) and errors or problems caused by wrong adjustments are avoided. In the case of a weaving machine, this tractive force can be stored in a file containing fabric characteristics in the control system of a weaving machine. In this manner quality errors such as creasing, crushing of the pile (of a pile fabric) fabric rolls of cloth wound too tight or too loose, etc. are avoided.

In a preferred method and a preferred device, the winding torque to be developed is determined by means of the following formula $$T_w=0.5*F_w*\sqrt{4*s_w*l_w/\pi+d_0^2}$$

Preferably, a method is applied and a device provided in which the said quantity is a control voltage (Vi) to be applied to the drive gear or control device, whereas this control voltage is calculated by means of a formula obtained by equating the winding torque ($T_w$) to be developed, expressed as a function of the desired tractive force ($F_w$), with the output torque ($T_{red}$) of the drive gear expressed as a function of the said control voltage ($V_i$).

In the method according to the present invention, the winding body is preferably rotatable by means of an electric motor, whereas the adjustment of the said quantity (Vi) results in an adjustment of the voltage ($V_{mot}$) applied to this electric motor.

The electric motor may be controlled, for instance, by means of a frequency converter, whereas the said quantity is the control voltage (Vi) to be applied to this frequency converter. The material to be wound is preferably a fabric, more particularly a pile fabric.

This control voltage (Vi) can be calculated by means of the following formula:

$$V_i=\sqrt{\frac{0{,}5*F_w*\sqrt{4*s_w*1_w/\pi+d_0^2}}{\eta*i*c_2*c_1^2*f(\theta)}}$$

in which $F_w$ is the desired tractive force, $s_w$ is the thickness of the material, $l_w$ is the wound up length of the material, $d_0$ is the initial winding diameter, $\eta$ is the efficiency of the geared motor unit, i is the gear ratio of the reduction, $c_i$ is the ratio between the voltage ($V_{mot}$) applied to the motor and the control voltage ($V_i$) to be applied to the frequency converter, $c_2$ is the ratio between the torque developed by the motor ($T_{mot}$) on the one hand and the square of the voltage ($V_{mot}$) applied to the motor and multiplied by a parameter f(θ) on the other hand, and f(θ) is a parameter which, according to a certain function, is dependent on the temperature of the motor.

When the material to be wound is a fabric that is wound during the weaving process, the length $l_w$ wound up during its winding process may be calculated by dividing the number of weft threads ($N_w-N_{w0}$), that was inserted from the moment the winding on the weaving machine started, by the weft density (S). The number of weft threads inserted ($N_w-N_{w0}$) may be determined by means of a pick counter on the weaving machine.

The above-mentioned "desired tractive force" can be kept practically constant during winding, in order to keep the circumstances, in which the material is wound during the complete winding process, practically constant.

More particularly during the winding of a fabric (when it is woven) the winding occurs rather slowly, so that calculating and adjusting the said quantity ($V_i$) with a frequency of not more than twice a second will be enough.

Of course, the present invention also relates to a winder having the characteristics mentioned in the second paragraph of this description, provided with or working together with a control device according to the present invention. In a preferred embodiment, this winder is a winder for a fabric, more particularly for a pile fabric.

In the following, a more detailed description of a possible embodiment of a winder for a fabric according to the present invention is given and a mathematical model is formed to calculate the control voltage for the control device of this winder. Nothing in this description however may be considered as a limitation of the protection requested in the claims for this invention.

In this description, reference is made, by means of reference numbers, to the attached FIG. 1 showing a block diagram of the winder.

DETAILED DESCRIPTION OF THE PREFERRED EMBODIMENTS

Figure 1:
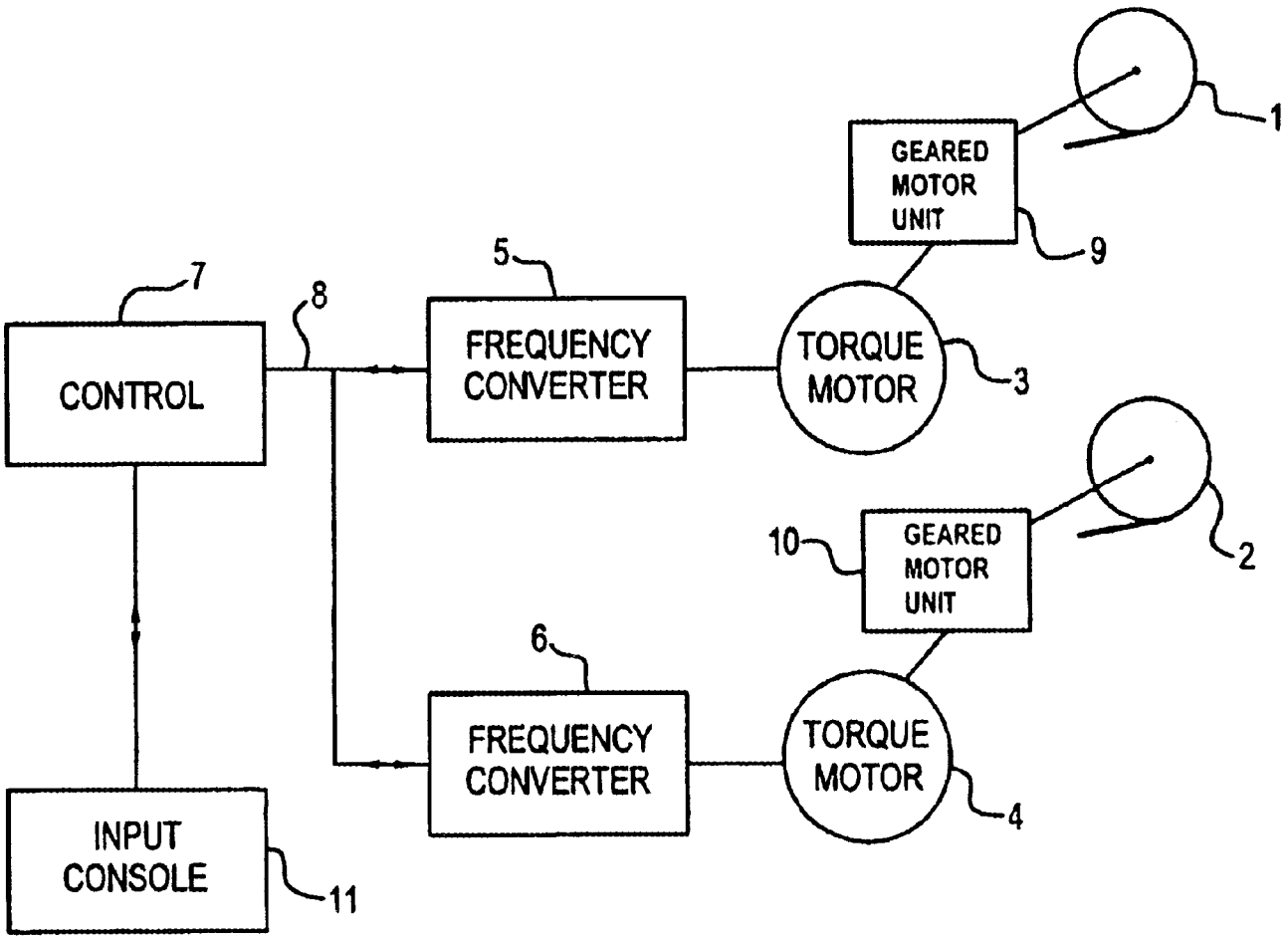
FIG. 1 shows a winder provided to wind two fabrics as they are woven on a weaving machine.

The winder shown in FIG. 1 is provided to wind two fabrics as they are woven on a weaving machine. The winder comprises two winding cylinders (1),(2) which may be driven by means of respective torque motors (3),(4) to wind a respective fabric. The torques ($T_{mot}$) developed by these torque motors (3),(4) may be controlled by means of respective frequency converters (5),(6), the output frequency of which is kept constant and of which only the activating or desired voltage ($V_i$) is modified as a function of the average motor voltage ($V_{mot}$). This desired voltage ($V_i$) is calculated pro-actively by the weaving machine control (7) in accordance with a mathematical model as a function of a number of parameters stored in the weaving machine and/or are calculated by this control in the course of the weaving process. The activating voltage ($V_i$) for the frequency converters calculated in accordance with the mathematical model is transferred digitally, via a serial line or a field bus (8), to the control of the frequency converters (5),(6) the output voltage ($V_{mot}$) of which is applied to the torque motor. Via a respective motor, the torque developed by each geared motor unit (9),(10) (with a total efficiency η and a ratio i) transferred to the winding cylinders (1),(2). Furthermore, also an input console (11) is provided, allowing a number of parameters to be entered into the weaving machine control and subsequently to be stored in the fabric characteristics file. This device functions very efficiently and is economic.

The motors of the winder may be activated in such a way that the exact tractive force ($F_w$), adapted to the fabric characteristics, is adjusted right from the initial winding diameter ($D_0$), and that this tractive force ($F_w$) is kept at a constant value during the weaving process and when the weaving machine is at a standstill until the final winding diameter for a given weaving length ($l_w$) on the cylinder is reached.

In the following, a mathematical model is made for the winder described above, in order to calculate the control voltage ($V_1$) to be applied to the frequency converters:

The torque $T_w$ to be applied to the winding cylinder with the existent winding diameter $d_w$, in order to create a tractive force $F_w$ in the fabric, is given by:

$$T_w=0.5*d_w*F_w$$

From the equation that the transversal section wound up, should be equal to the transversal section of the outstretched length, the real winding diameter $d_w$ is calculated as a function of the woven length $l_w$.

$$\text{From} \quad \pi*(d_w^2-d_0^2)/4=s_w*l_w$$

$$\text{follows} \quad d_w=\sqrt{4*s_w*l_w/\pi+d_0^2}$$

in which $d_w$ represents the real winding diameter, $s_w$ the thickness of the fabric, $l_w$ the woven length and do the initial winding diameter.

The woven length $l_w$ is calculated by dividing the actual number of woven wefts, after a new cylinder has been put on, by the weft density (S):

$$l_w=(N_w-N_{w0})/S$$

Herewith the torque to be applied to the winding cylinder becomes:

$$T_w=0.5*F_w*\sqrt{4*s_w*l_w/\pi+d_0^2}$$

The voltage $V_{mot}$ applied to a motor (3),(4) by a frequency converter (5),(6) is proportional to the control or desired voltage $V_1$ which is applied to the converter (5),(6). This is represented in an equation of the form:

$$V_{mot}=c_1*V_i$$

The torque $T_{mot}$ that is developed by a torque motor is proportional to the square of the voltage $V_{mot}$ applied and that torque is corrected for the temperature of the motor in accordance with a function f(θ):

$$T_{mot}=c_2*V_{mot}^2*f(\theta)$$

The motor temperature θ is calculated by the machine control, because the switching on torque of the torque motor for normal ambient temperatures is known to this control, and also the control value of the voltage for the motor control.

The output torque of the geared motor unit (9),(10) is $T_{red}$ and is:

$$T_{red}=\eta*i*T_{mot}$$

where η represents the overall efficiency of the geared motor unit (9),(10) and i the ratio of the reduction gear. Substituting the motor torque gives the following relation:

$$T_{red}=\eta*i*c_2*c_1^2*V_i^2*f(\theta)$$

Equalization of the output torque ($T_{red}$) of the reduction gear (9),(10) with the desired winding torque gives the equation:

$$\eta*i*c_2*c_1^2*V_i^2*f(\theta)=0.5*F_w*\sqrt{4*s_w*l_w/\pi+d_0^2}$$

from which $V_1$ can be calculated:

$$V_i=\sqrt{\frac{0,5*F_w*\sqrt{4*s_w*1_w/\pi+d_0^2}}{\eta*i*c_2*c_1^2*f(\theta)}}$$

The total voltage to be applied to the converter is the total of the voltage ($V_{iO}$) which has to be applied when the winding is started (at the initial winding diameter ($d_0$) and the calculated control voltage ($V_i$):

$$V_c=V_{iO}+V_i$$

Therefore, the activating voltage ($V_i$) of the converter can be calculated proactively by the weaving machine control as a function of a number of parameters that have been stored in the weaving control and/or are calculated during the running time. Given the slow winding, the calculation frequency may be low, for instance each 500 ms of each second. The adjustments for winding force ($F_w$), winding length ($l_w$) on the cylinder, thickness of the fabric ($s_w$), and weft density (S) can be stored in the fabric characteristics file in the weaving machine control. The initial winding diameter ($d_0$) can be entered and, if necessary, be adapted via the input console (11) of the control. The number of weft really woven is inquired from the pick counter of the weaving machine during the weaving process.

For winding fabrics on the winder shown in FIG. 1 the procedure is, for instance, as follows:

Via the input console (11) the following data are entered:

the desired tractive force ($F_w$) on the fabric during the winding process, the initial winding diameter ($d_0$), the thickness ($s_w$) of the fabric, the weft density (S) of the fabric.

These data are then stored and saved in the fabric characteristics file for reuse later on or on another weaving machine.

The following parameters are stored in the weaving machine control, which are required to calculate the control voltage ($V_i$) of the frequency converter (5),(6):

the overall efficiency (η) of the geared motor unit.

the ratio (i) of the geared motor unit, the parameter $c_1$, which is characteristic for the frequency converter (5),(6), the parameter $c_2$, which is characteristic for the torque motor (3),(4).

During weaving the number of woven weft threads is registered by the pick counter. From this information and from the weft density (S) the woven length ($l_w$) is calculated by the machine control (7). During the winding process also the motor temperature θ is calculated by the machine control from the registered period of operation of the motor (3),(4), the voltage $V_{mot}$ applied to the motor (3),(4), which is known by the control (7) and the warming up characteristics of the torque motor (3),(4).

From this data the value of the control voltage ($V_i$) is calculated, for instance every 500 ms, by the machine control, by means of the formula given before, in order to obtain the constant tractive force ($F_w$) desired.

The calculated value ($V_i$) is transferred digitally to the frequency converter (5),(6), which in turn applies an output voltage $V_{mot}$ to the torque motor (3),(4), resulting in a motor torque ($T_{mot}$) and an output torque $T_{red}$ transferred to the winding cylinder (1),(2), which finally produces the desired tractive force ($F_w$) on the fabric.

This device functions very efficiently and is particularly economic.

What is claimed is:

1. Method to control a winder, where during the winding process the winding torque (Tw) is controlled as a function of the desired tractive force (Fw) in the material that is wound, characterized in that during winding, repeatedly calculating value of a quantity (Vi), influenced by winding torque (Tw) whereas in each calculation a winding torque (Tw) to be developed is assumed, which is determined from the desired tractive force (Fw), the initial winding diameter (do), the thickness (sw) and the wound length(lw) of the material, and adjusting of said quantity (Vi) is carried out, relative to the winding torque value (Tw).

2. Method to control a winder according to claim 1, characterized in that said quantity is a control voltage ($V_i$) to be applied to a drive device or a control device and that his control voltage ($V_i$) is calculated by means of a formula obtained by equalizing the winding torque ($T_w$) to be developed, expressed as a function of the desired tractive force ($F_w$), to the output torque $T_{red}$ of the drive device, expressed as a function of said control voltage ($V_i$).

3. A Method to control a winder according to claim 1, characterized in that the winding body is rotatable by means of an electric motor and that the adjustment of said quantity ($V_i$) results in an adjustment of the voltage ($V_{mot}$) applied to this electric motor.

4. Method to control a winder according to claim 3, characterized in that the electric motor is controlled by means of a frequency converter and in that the said quantity is the control voltage ($V_i$) to be applied to this frequency converter.

5. Method to control a winder according to claim 1, characterized in that the material is a fabric, more particularly a pile fabric.

6. Method to control a winder according to claim 4, characterized in that the said control voltage ($V_i$) is calculated by means of the following formula:

$$V_i = \sqrt{\frac{0{,}5 * F_w * \sqrt{4 * s_w * 1_w / \pi + d_0^2}}{\eta * i * c_2 * c_1^2 * f(\theta)}}$$

in which $F_w$ is the desired tractive force, $S_w$ is the thickness of the material, $l_w$ is the wound up length of the material, $d_0$ is the initial winding diameter, $\eta$ is the efficiency of the geared motor unit, i is the gear ratio of the reduction gear, $c_i$ is the ratio between the voltage ($V_{mot}$) applied to the motor and the control voltage ($V_i$) to be applied to the frequency converter, $c_2$ is the ratio between the torque developed by the motor ($T_{mot}$) on the one hand and the square of the voltage ($V_{mot}$) applied to the motor, multiplied by a parameter f(θ) on the other hand, and f(θ) is a parameter which, according to a certain function, is dependent on the temperature of the motor.

7. Method to control a winder according to claim 1, characterized in that the material is a fabric, in that the fabric is wound during its weaving process on a weaving machine, and in that the wound length ($l_w$) during winding is calculated by dividing the number of weft threads ($N_w$−$N_{w0}$) that has been inserted, from the moment the winding on the weaving machine was started, by the well density (S).

8. Method to control a winder according to claim 7, characterized in that the number of weft threads ($N_w$−$N_{w0}$) is determined by a pick counter on the weaving machine.

9. Method to control a winder according to claim 1, characterized in that the desired tractive force during winding is practically constant.

10. Method to control a winder according to claim 1, characterized in that the said quantity is calculated and controlled during winding at a frequency of not more than two times a second.

11. Method to control a winder, where during the winding process the winding torque (Tw) is controlled as a function of the desired tractive force (Fw) in the material that is wound characterized in that during winding, repeatedly calculating value of a quantity (Vi), influenced by the winding torque (Tw) whereas in each calculation a winding torque (Tw) to be developed is assumed, which is determined from the desired tractive force (Fw), the initial winding diameter (do), the thickness (sw) and the wound length (lw) of the material calculated according to the following formula:

$$Tw = 0.5Fw * \sqrt{4 * sw * 1w / \pi + do \wedge 2}$$

adjusting of said quantity (Vi) is carried out, relative to the winding torque value (Tw).

12. Method to control a winder, where during the winding process the winding torque (Tw) is controlled as a function of the desired tractive force (Fw) in the material that is wound, characterized in that during winding the device is provided for repeatedly calculating value of a quantity (Vi), influenced by the winding torque (Tw) whereas in each calculation a winding torque (Tw) to be developed is assumed, which is determined from the desired tractive force (Fw), the initial winding diameter (do), the thickness (sw) and the wound length (lw) of the material, and adjusting of said quantity (Vi) is carried out, to the winding torque value (Tw).

13. Device to control a winder according to claim 12, characterized in that said quantity ($V_i$) is a control voltage ($V_i$) and that this control voltage ($V_i$) is calculated by means of a formula obtained by equalizing the winding torque ($T_w$) to be developed, expressed as a function of the desired tractive force ($F_w$), to the output torque $T_{red}$ of the drive device, expressed as a function of said control voltage ($V_i$).

14. Device to control a winder according to claim 13, characterized in that it comprises a frequency converter, in that the said quantity is the control voltage ($V_i$) to be applied to the frequency converter, and in that said control voltage ($V_i$) is calculated from the following formula:

$$V_i = \sqrt{\frac{0{,}5 * F_w * \sqrt{4 * s_w * 1_w / \pi + d_0^2}}{\eta * i * c_2 * c_1^2 * f(\theta)}}$$

in which $F_w$ is the desired tractive force, $S_w$ is the thickness of the material, $l_w$ is the wound up length of the material, $d_0$ is the initial winding diameter, c is the efficiency of the geared motor unit, i is the gear ratio of the reduction gear, $c_i$ is the ratio between the voltage ($V_{mot}$) applied to the motor and the control voltage ($V_l$) to be applied to the frequency converter, $c_2$ is the ratio between the torque developed by the motor ($T_{mot}$) on the one hand and the square of the voltage ($V_{mot}$) applied to the motor, multiplied by a parameter f(é) on the other hand, and f(é) is a parameter which, according to a certain function, is dependent on the temperature of the motor.

15. Device for winding a material according to claim 12, characterized in that the material is a fabric that is wound during its weaving, and in that the wound up length ($l_w$) during winding is calculated by dividing the number of weft threads ($N_w$–$N_{w0}$), that has been inserted from the moment the winding on the weaving machine was started, by the weft density (S).

16. Device to control a winder according to claim 15, characterized in that the number of weft threads ($N_w$–$N_{w0}$) that has been inserted is determined by a pick counter on the weaving machine.

17. Device to control a winder according to claim 12, characterized in that the control device is provided for calculating and adjusting said value ($V_l$) during winding at a frequency of not more than two times a second.

18. Winder, comprising a winding body for winding material, a drive device for driving this winding body and a device for controlling the winder, which is provided for an automatic control of the winding torque of the drive device as a function of the desired tractive force ($F_w$) in the material that is wound, characterized in that said device for controlling the winder is a device according to claim 17.

19. Winder according to claim 18, characterized in that it is a winder for a fabric, more particularly for a pile fabric.

20. Method to control a winder, where during the winding torque (Tw) is controlled as a function of the desired tractive force (Fw) in the material that is wound, characterized in that during winding, repeatedly calculating value of a quantity (Vi), influenced by the winding torque (Tw) whereas in each calculation a winding torque (Tw) to be developed is assumed, which is determined from the desired tractive force (Fw), the initial winding diameter (do), the thickness (sw) and the wound length (lw) of the material calculated according to the following formula:

$$Tw = 0.5Fw * \sqrt{4 * sw * 1w/\pi + do \wedge 2}$$

adjusting of said quantity (Vi) is carried out, relative to the winding torque value (Tw).

* * * * *